US012024341B1

(12) United States Patent
Lange et al.

(10) Patent No.: US 12,024,341 B1
(45) Date of Patent: Jul. 2, 2024

(54) DISPENSER AND CONTENT CONTAINER

(71) Applicant: MC2 Therapeutics, Ltd., Guildford (GB)

(72) Inventors: Jesper J. Lange, Hørsholm (DK); Jakob Grupe Larsen, Allerød (DK); Thomas Lund, Allerød (DK)

(73) Assignee: MC2 Therapeutics, Ltd., Hørsholm (DK)

( * ) Notice: Subject to any disclaimer, the term of this patent is extended or adjusted under 35 U.S.C. 154(b) by 0 days.

(21) Appl. No.: 18/525,100

(22) Filed: Nov. 30, 2023

(51) Int. Cl.
*B65D 47/12* (2006.01)
*B65D 35/44* (2006.01)

(52) U.S. Cl.
CPC ..... *B65D 47/127* (2013.01); *B65D 35/44* (2013.01); *B65D 2547/063* (2013.01)

(58) Field of Classification Search
CPC ..... B65D 81/3841; B65D 41/0414; B65D 81/3839; B65D 85/72; B65D 39/08; B65D 47/127; B65D 51/242; B65D 77/0493; B65D 81/3876; A47J 41/0011; A47J 41/0072; A47J 41/02
USPC ..... 222/92, 95, 96, 142.5, 153.09, 324, 498, 222/538
See application file for complete search history.

(56) References Cited

U.S. PATENT DOCUMENTS 3,613,955 A * 10/1971 Wetherell, Jr. ..... B67B 7/26 222/541.6
4,969,577 A * 11/1990 Werding ..... B65D 83/14 222/105
5,421,483 A * 6/1995 Parise ..... B05B 11/0078 222/129
5,529,217 A * 6/1996 Siegel ..... A45F 3/20 215/229
7,331,486 B2 * 2/2008 Mon ..... B05B 11/0081 222/129
10,052,643 B2 * 8/2018 Moretti ..... B65D 1/023
11,700,928 B2 * 7/2023 Zheng ..... B05B 11/1046 222/153.09
2022/0234811 A1 * 7/2022 Deng ..... A47J 41/0072

* cited by examiner

*Primary Examiner* — Vishal Pancholi
(74) *Attorney, Agent, or Firm* — Shore IP Group, PLLC; Howard J. Klein

(57) ABSTRACT

The disclosure relates to a dispenser and a content container for dispensing a liquid material, such as a cosmetic cream contained in a content container. The dispenser includes a container body having a bottom and a sidewall extending from the bottom and arranging an opening opposite to the bottom. The container body is adapted for containing the collapsible content container. The dispenser includes a detachable dispenser head with a dispenser nozzle for dispensing the liquid. The dispenser head includes pressure sensitive locking means for releasable locking the dispenser head to a cooperating locking assembly arranged on the content container.

20 Claims, 6 Drawing Sheets

DISPENSER AND CONTENT CONTAINER

FIELD

The present disclosure relates to a dispenser and, more particularly, to a dispenser and a content container for use in the dispenser.

BACKGROUND

Dispensers have been widely available on the market in a wide variety of designs for years and are primarily used for cosmetics and topical drugs and medical devices for the purpose of dispensing liquid products, such as, for example, creams, lotions, gels and the like.

Compressible dispensers are typically suitable for delivering a liquid product by the action of manual pressure applied by a user to the dispenser. The compressible dispensers may be of the type where the liquid product contained is not in contact with the air when being dispensed, which helps ensure the stability and preservation of the product.

Compressible dispensers are typically suitable for delivering a liquid product by the action of manual pressure applied to the walls thereof.

Some dispensers comprise a housing and an internal exchangeable container comprising the liquid, where the internal container, when empty, may be exchanged with a new full container for continued use.

However, these containers typically having a screw connection between the parts and therefore the parts of the container suffer from the problem that the internal container may be accidentally removed during dispensing, or the parts not being correctly aligned with each other.

Dispenser parts typically need to be positioned in an open and close position, which increases the chances of malfunction between of the dispenser, thus limiting the positioning of the dispenser for dispensing, and providing a high risk of contamination of the liquid.

Other types of dispensers have a substantially rigid reservoir for the liquid product. Such dispensers typically have a pump device to transport the liquid product from the reservoir to the place of application. The pump device typically has a rather complex structure and may include a piston or metallic parts such as a spring not suitable to dispense smaller doses of liquid. Current dispensers are generally disposables and are therefore not reusable.

SUMMARY

Provided in accordance with aspects of the present disclosure is a dispenser assembly including a content container configured to hold a liquid. The content container includes a cooperating locking means. A container body includes a bottom and a sidewall extending from the bottom. The container body defines an opening opposite to the bottom. The container body is configured to receive the content container. A dispenser head is configured to be removably coupled with the content container. The dispenser head includes a dispenser nozzle configured to dispense the liquid held in the content container. The dispenser head includes a pressure-sensitive locking assembly configured to be releasably coupled with the cooperating locking means of the content container to releasably couple the dispenser head with the content container.

In an aspect of the present disclosure, the pressure-sensitive locking assembly includes opposed pressure-sensitive parts moveable by an applied pressure toward each other in first and second opposed directions aligned on a first linear path. The pressure-sensitive locking assembly includes opposed locking parts moveable by the opposed pressure-sensitive parts away from each other in third and fourth opposed directions aligned on a second linear path. The first linear path is perpendicular to the second linear path. The opposed locking parts are configured to be engaged with the cooperating locking means of the content container.

In an aspect of the present disclosure, the opposed pressure-sensitive parts and the opposed locking parts define a unitary structure.

In an aspect of the present disclosure, at least one of the opposed pressure-sensitive parts or the opposed locking parts include a biasing element. The biasing element is configured to bias the opposed locking parts toward each other.

In an aspect of the present disclosure, the dispenser head includes a guide means. The guide means is configured to guide the opposed locking parts away from each other in the third and fourth directions, respectively.

In an aspect of the present disclosure, the content container defines an opening configured to dispense the liquid to the dispenser nozzle. The pressure-sensitive locking means is configured to be releasably coupled with the cooperating locking means of the content container adjacent the opening.

In an aspect of the present disclosure, the pressure-sensitive locking means defines deformable regions between the opposed pressure-sensitive parts and the opposed locking parts. The deformable regions are configured to allow the opposed pressure-sensitive parts and the opposed locking parts to be displaced with respect to each other.

In an aspect of the present disclosure, the content container includes a content housing part configured to hold the liquid and a content housing lid part configured to seal the liquid within the content container.

In an aspect of the present disclosure, the content housing part is configured to be collapsible.

In an aspect of the present disclosure, the dispenser head includes at least two projecting elements configured to be received in the opening of the container body. The projecting elements are configured to prevent deformation of the container body in the region of the projecting elements.

In an aspect of the present disclosure, the content container defines at least two cutouts configured to engage the projecting elements, respectively.

In an aspect of the present disclosure, the content container includes at least two content container locking means configured to couple the content container with the container body.

In an aspect of the present disclosure, a dispenser lid is configured to cover the dispenser head.

In an aspect of the present disclosure, the dispenser lid is configured to be removably coupled with the pressure-sensitive locking means.

In an aspect of the present disclosure, the dispenser lid defines a nozzle engagement portion configured to be coupled with the dispenser nozzle to prevent liquid from being dispensed through the dispenser nozzle.

In an aspect of the present disclosure, the nozzle engagement portion defines a shape corresponding with a shape defined by the dispenser nozzle.

In an aspect of the present disclosure, the content container lid part includes a first sealing part. The container body includes a second sealing part. The first sealing part is configured to be engaged with the second sealing part to establish a pressure-tight seal between the content container lid part and the container body.

In an aspect of the present disclosure, the content container defines an opening configured to dispense the liquid through the dispenser nozzle. The content container includes a sealing covering the opening of the content container. The dispenser head includes a piercing means configured to pierce the sealing of the content container to dispense the liquid from the content container.

In an aspect of the present disclosure, at least one of the container body or the dispenser head includes a one-way valve.

Provided in accordance with aspects of the present disclosure is a dispenser assembly including a flexible content container. The flexible content container includes a content housing part configured to hold a liquid. The flexible content container includes a content housing lid part configured to seal the liquid in the content housing part. The flexible content container includes a content container locking means. The content container locking means defines a first projection extending in a first direction and a second projection extending in a second direction opposite the first direction. The flexible content container includes a first projecting element extending in a third direction. The flexible content container includes a second projecting element extending in a fourth direction opposite the third direction. The third and fourth directions are perpendicular to the first and second directions. The flexible content container includes a cooperating locking means. The dispenser assembly includes a container body. The container body is configured to receive the flexible content container. The content container locking means is configured to removably couple the flexible content container with the container body. The first projecting element and the second projecting element are configured to prevent deformation of the container body. A dispenser head is configured to be removably coupled with the flexible content container. The dispenser head includes a dispenser nozzle configured to dispense the liquid held in the flexible content container. A pressure-sensitive locking means is configured to be releasably coupled with the cooperating locking means of the flexible content container to releasably couple the dispenser head with the flexible content container.

BRIEF DESCRIPTION OF THE DRAWINGS

Various aspects and features of the present disclosure are described hereinbelow with reference to the drawings wherein:

FIG. 4B is an enlarged view of a portion of the cross-sectional view of FIG. 4A.

DETAILED DESCRIPTION

Figure 1A:
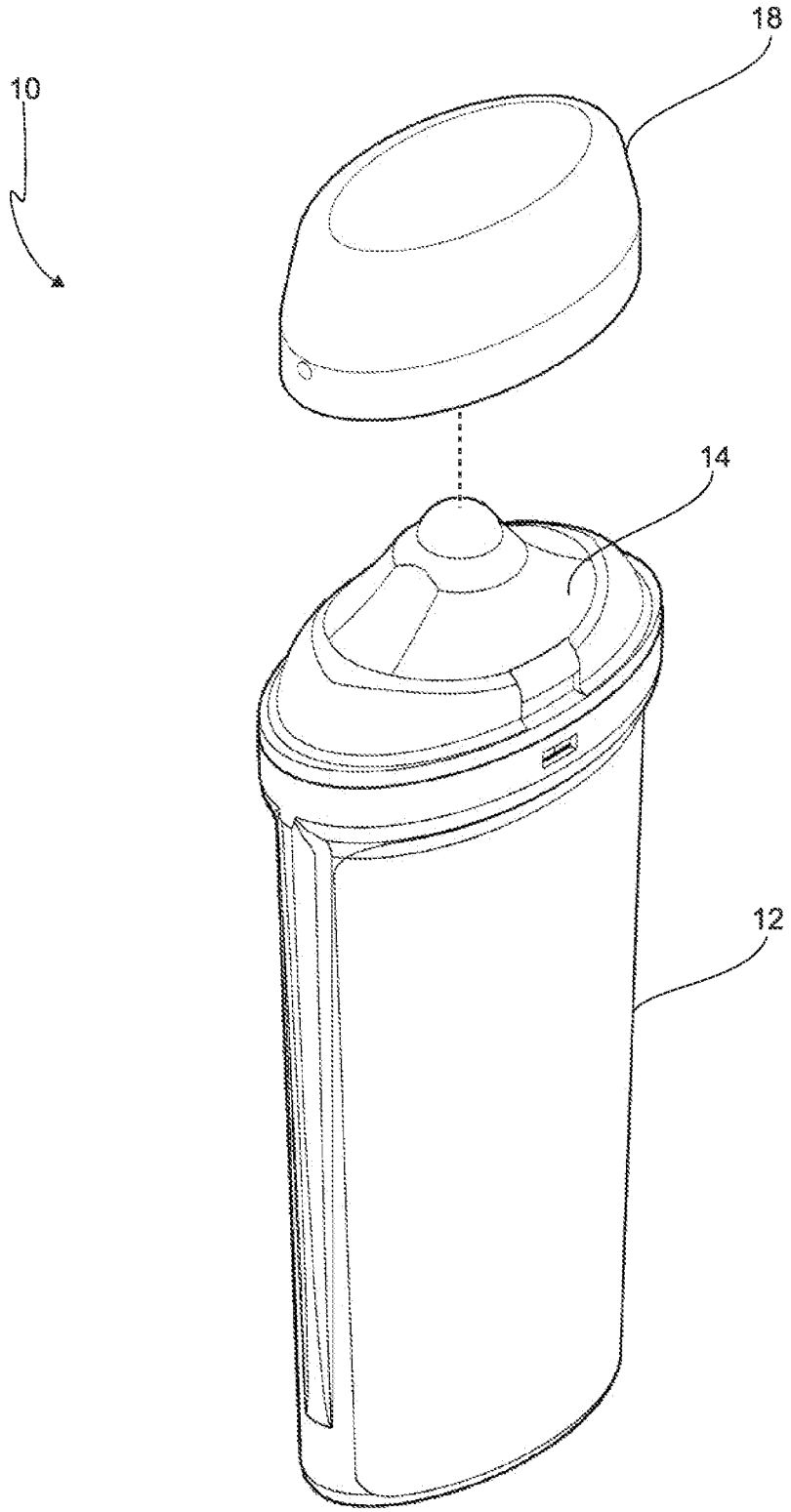
FIG. 1A is perspective view of a dispenser according to aspects of the present disclosure.

The present disclosure will now be described more fully hereinafter with reference to the accompanying drawings, in which exemplary embodiments of the disclosure are shown and described. The disclosure may, however, be embodied in different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout. Like elements may thus not be described in detail with respect to the description of each figure.

It is an object of the disclosure to provide a dispenser which can be reused, and which prevents accidental removal of the content container, misaligned parts and prevents accidental dispensing of the material and which solves the issues described herein.

The above object and advantages, together with numerous other objects and advantages, which will be evident from the description of the present disclosure, are described in more detail below and herein, such as with reference to various aspects of the disclosure.

A dispenser for dispensing a liquid material, such as a cosmetic cream contained in a flexible content container, comprises a container body having a bottom and a sidewall extending from the bottom and arranging an opening opposite to the bottom (e.g., at an upper end portion of the container body). The container body is adapted for containing the content container, The dispenser further comprises a detachable dispenser head with a dispenser nozzle for dispensing the liquid. The dispenser head comprises pressure sensitive locking means for releasable locking said dispenser head to cooperating locking means arranged on the content container.

In a preferred embodiment of the dispenser, the container body and the dispenser head include or are manufactured from the same material, such as, for example, a polymer material such as polyethylene, polypropylene, polyurethane, polystyrene, polyvinylchloride, or a variant of thermoplastic elastomers. The container body may thus be squeezed by a user in order to press liquid out of the dispenser via the dispenser head.

The dispenser forms by the container body and the dispenser head a closed chamber in which the content container can be positioned. The closed chamber may be pressurized by deforming at least one deformable area on the container body. The user may simply squeeze on the container body which deforms, thereby creating an overpressure around the collapsible content container which squeezes the liquid out of the dispenser head. Thus, when the wall(s) of the container body is/are squeezed, a higher pressure is established in the chamber between the flexible content container and the container body. This pressure affects the flexible content container and the pressure squeezes liquid out of the content container through the dispenser head and out of a nozzle in the dispenser head. It is thereby possible to dispense relatively smaller doses of liquid if so desired or required.

Arranging the dispenser head with pressure-sensitive locking means which may be manipulated by a user without any turning of the dispenser parts ensure that the locking means may be displaced in and out of locking engagement with the connection with a cooperating locking means arranged in the content container. Further, connecting the dispenser head directly to the content container has the technical effect that the parts are correctly positioned in relation to each other once interconnected. Thus, a more reliable, fail safe and operator friendly dispenser is provided.

In a possible embodiment of the dispenser, the container body comprises a valve, such as a one-way valve in the bottom of the container body. The valve may serve to equalize the pressure in the closed chamber around the collapsible content container, such that the pressure corresponds to the surrounding pressure after an actuation is applied.

In a further possible embodiment of the dispenser, a small temporary vacuum may be created in the closed chamber when the actuation pressure is released on the deformable area on the container body, The small vacuum will result in some of the liquid in the outlet channel being sucked back, thus again resulting in a clean cut of the dispensed liquid flow and preventing excess liquid on the outside of the container. The small vacuum may be created by a delay in the one-way valve, such that pressure in the closed chamber is equalized only after a period from the squeezing on the container body has stopped, such that the temporary vacuum appears.

According to a further embodiment of the first aspect of the disclosure, the pressure-sensitive locking means comprises opposed pressure-sensitive parts moveable by an applied pressure toward each other in a first and second opposed direction aligned on a first linear path, and opposed locking parts being moveable by the pressure-sensitive parts, away from each other in a third and fourth opposed direction aligned on a second linear path. The first linear path may be perpendicular to the second linear path. The opposed locking parts are arranged for engaging with the cooperating locking means arranged on the content container.

Arranging the pressure-sensitive parts to be operated toward each other in first and second directions aligned on a first linear path and the opposed locking parts, by the pressure-sensitive parts, being operated to and from each other in a third and fourth direction aligned on a second linear path substantially perpendicular to the first linear path, has the technical effect that the pressure-sensitive locking means may have a relatively simple structural arrangement while still providing a reliable and operator friendly locking operation from opposite sides of the container.

According to a further embodiment of the first aspect of the disclosure, the opposed pressure-sensitive parts and the opposed locking parts are unitary.

Arranging the pressure-sensitive parts and the locking parts as a unitary element, preferable as the technical effect that a simple, yet effective pressure-sensitive locking means is provided. The unitary configuration eliminates the use of a high number of locking parts needed for providing the locking means, and hereby eliminates the higher risk of malfunction.

According to a further embodiment of the first aspect of the disclosure, the opposed pressure-sensitive parts or the opposed locking parts comprising biasing elements, bias the opposed locking parts toward each other.

The pressure-sensitive locking means further comprises biasing elements biasing the locking parts toward each other and into engagement with the cooperating locking means arranged in the content container. The biasing elements are arranged such that they may be overcome by a predefined force, corresponding to a desired force needed by a used to press the pressure-sensitive parts toward each other resulting in the locking parts disengaging the cooperating locking means.

The biasing elements ensure that a certain amount of pressure is needed for disengaging the locking parts such that the dispenser head is not accidentally removed from the content container.

According to a further embodiment of the first aspect of the disclosure, the dispenser head comprises guide means for guiding the opposed locking parts in the third and fourth direction.

As the pressure-sensitive locking means operate on a first linear path and the locking parts operate on a second linear path being substantial perpendicular to the first linear path, the guide means ensure that the opposed locking parts are correctly guided into and out of engagement with the cooperating locking means on the content container, such that any misalignment is eliminated.

According to a further embodiment of the first aspect of the disclosure, the content container comprises an opening for dispensing the liquid to the nozzle, the pressure-sensitive locking means being arranged for encircling the opening and for engaging the content container around said opening.

The pressure-sensitive locking means are arranged encircling the opening of the content container whereby each of the locking parts are effectuated by the operation of each pressure-sensitive part which ensures a stabile operation of the locking.

According to a further embodiment of the first aspect of the disclosure, the pressure-sensitive locking means between the opposed pressure-sensitive parts and the opposed locking parts comprises deformable regions, such that the opposed pressure-sensitive parts and the opposed locking parts can be displaced in relation to each other.

In order to ensure a correct equal transfer of forces from the pressure-sensitive parts to the locking parts, the pressure-sensitive locking means, between the pressure-sensitive parts and the locking parts, comprises deformable regions such that the pressure-sensitive locking means deforms uniformly during each operation and thereby more reliable.

According to a further embodiment of the first aspect of the disclosure, the dispenser comprises a content container having a content housing part containing said liquid and a content housing lid part, sealing the liquid within the content container.

The dispenser comprises in an example embodiment a content container containing the liquid to be dispensed. The content container is, as previously described, exchangeable in relation to the container body, such that the container body and the dispenser head can be re-used several times and the content container replaced, such as when the content container is empty.

According to a further embodiment of the first aspect of the disclosure, the content housing part is collapsible or compressible.

The content container may be arranged as a collapsible content container which can be replaced when empty. In an exemplary embodiment, the collapsible content container is a bag, such as a bag manufactured from a foil made from or including a metallic or polymeric material.

According to a further embodiment of the first aspect of the disclosure, the dispenser head, at opposite sides thereof, comprises projecting elements, such as projecting lugs, for projecting through said opening of the container body, for preventing a deformation of the container body in the region of the projecting elements.

The dispenser head comprises projecting elements arranged on opposite sides of the dispenser head, for protruding through the opening of the container body close to or abutting against the inner side of the wall(s) of the container body.

When pressing the side at the dispenser having the projecting elements, when the dispenser head is connected to the container body, the projecting elements abut the inner side of the container body wall and prevent the container body from being deformed by a squeezing. This prevents the content container locking means from disengaging the corresponding openings in the container body and thereby preventing the content container from being unintentionally removed from the container body.

According to a further embodiment of the first aspect of the disclosure, the content container comprises cutouts for engaging said projecting elements.

Providing the content container with cutouts results in a compact arrangement and the parts being correctly aligned in relation to each other.

According to a further embodiment of the first aspect of the disclosure, the content container comprises content container locking means for engaging the container body, the content container locking means being opposed in the first and second direction, and the projecting elements being opposed in the third and fourth direction.

Arranging the projecting elements at first opposing sides, such as the low curvature sides of an oval shaped container, and arranging the content container locking means as second opposite sides, such as the high curvature sides, has the technical effect, that when the container body, the content container and the dispenser head are all connected, the projecting elements prevents a deforming of the container body, such that the content container locking means cannot be disengaged and the content container unintentionally removed.

It should be noted, that though an oval shape is described and illustrated in the drawings, the disclosure is not limited to such. The dispenser may in principle have other shapes such as square, circular, etc.

According to a further embodiment of the first aspect of the disclosure, the dispenser further comprises a dispenser lid for covering the dispenser head.

The dispenser further comprises a lid which protects the dispenser nozzle when the dispenser is not being used. The lid may be arranged separately or may be hinged to the container body.

According to a further embodiment of the first aspect of the disclosure, the dispenser lid engages the opposed pressure-sensitive parts.

In order to secure the lid in place, the lid engages the pressure-sensitive parts, such as in a snap fit connection. As the pressure-sensitive parts can bias inwards and as the lid is flexible in the first and second direction, the lid is able to snap over the pressure-sensitive parts. Preferably, the lid comprises on the inside cooperating elements engaging the pressure-sensitive parts, such as in a snap fit connection. The pressure-sensitive parts when engaging with the lid, will only be slightly manipulated such that the locking parts do not disengage with the cooperating locking means on the content container.

According to a further embodiment of the first aspect of the disclosure, the dispenser lid comprises a nozzle engagement portion engaging the dispenser nozzle when the dispenser lid is covering the dispenser head nozzle for preventing unintentionally dispensing of liquid through the nozzle.

The container lid is on the inner top side thereof, arranged with a nozzle engagement portion. The nozzle engagement position presses against the dispenser nozzle when the dispenser lid is attached, whereby it is ensured that a small remaining amount of liquid still present in the dispenser nozzle, will not flow out of the dispenser nozzle and into the dispenser lid.

According to a further embodiment of the first aspect of the disclosure, the nozzle engagement portion conforms to the dispenser nozzle (e.g., has a shape corresponding with a shape of the dispenser nozzle).

The nozzle engagement portion has a shape such that it conforms to the shape of the dispenser nozzle. It is hereby ensured that space between the dispenser nozzle and the dispenser lid is kept at a minimum, such that even if a small amount of liquid would escape the dispenser nozzle, it would be an insignificantly low amount of liquid.

According to a further embodiment of the first aspect of the disclosure, the content container lid part comprises a first sealing part and the container body comprises second sealing part engaging the first sealing part for establishing a pressure-tight chamber between the content container and the housing.

In order to pressurize the dispenser between the container body and the content container, the content container and the container body are arranged with sealing parts, such that the pressure increases when the container body is squeezed. This ensures that most liquid can be dispensed out of the content container. The previously described valve, such as a one-way valve, serves to equalize the pressure in the closed chamber around the content container after an actuation is applied.

According to a further embodiment of the first aspect of the disclosure, the dispenser head comprises piercing means for piercing a sealing of the content container such as a foil covering an opening of the content container, such that the liquid can be dispensed out of the content container.

A new content container to be inserted into the dispenser has a sealing for protecting the liquid before use.

When inserting the new, full content container into the container body, and the dispenser head is connected, the foil needs to be pierced. The dispenser head therefore comprises piercing means, which pierces the foil, whereby the liquid can be dispensed out of the content container and out of the dispenser.

According to a further embodiment of the first aspect of the disclosure, the container body or the dispenser head comprises a one-way valve, such as in the bottom of the container body.

The one-way valve serves to equalize the pressure in the closed chamber around the collapsible content container and the container body, such that the pressure corresponds to the ambient pressure after an actuation is applied. The one-way valve is user-friendly as the user is not required to use his fingers to close a venting opening.

FIG. 1A shows a perspective view of a dispenser 10. The dispenser 10 illustrated shows one possible embodiment according to the disclosure.

The dispenser comprises at least a container body 12, a dispenser lid 18, and a dispenser nozzle 14 for dispensing a liquid contained within the container body 12, such as a liquid arranged directly inside the container body 12, but preferably a liquid contained inside a content container 16 (shown on FIG. 1B) arranged inside the container body 12 as a separate unit that may be connected to the container body 12.

In an embodiment of the dispenser 10 the container body 12, the lid dispenser 18, and the dispenser head 14 are manufactured from the same material, such as, for example, a polymer material such as polyethylene, polypropylene, polyurethane, polystyrene, polyvinylchloride, or a variant of thermoplastic elastomers. By producing most or all parts of the dispenser using the same type of material recycling of the dispenser becomes easier when disposed.

However, in an alternative embodiment, the container body 12 may be made from a hard material such as a metallic material, such as steel or aluminum. Thus, it is possible to provide a longer lasting and more durable dispenser, which can be re-used several times. In such a case, parts of the container body 12 may be arranged with compressible regions, such as polymer regions which can be squeezed in order to dispense the liquid.

Figure 1B:
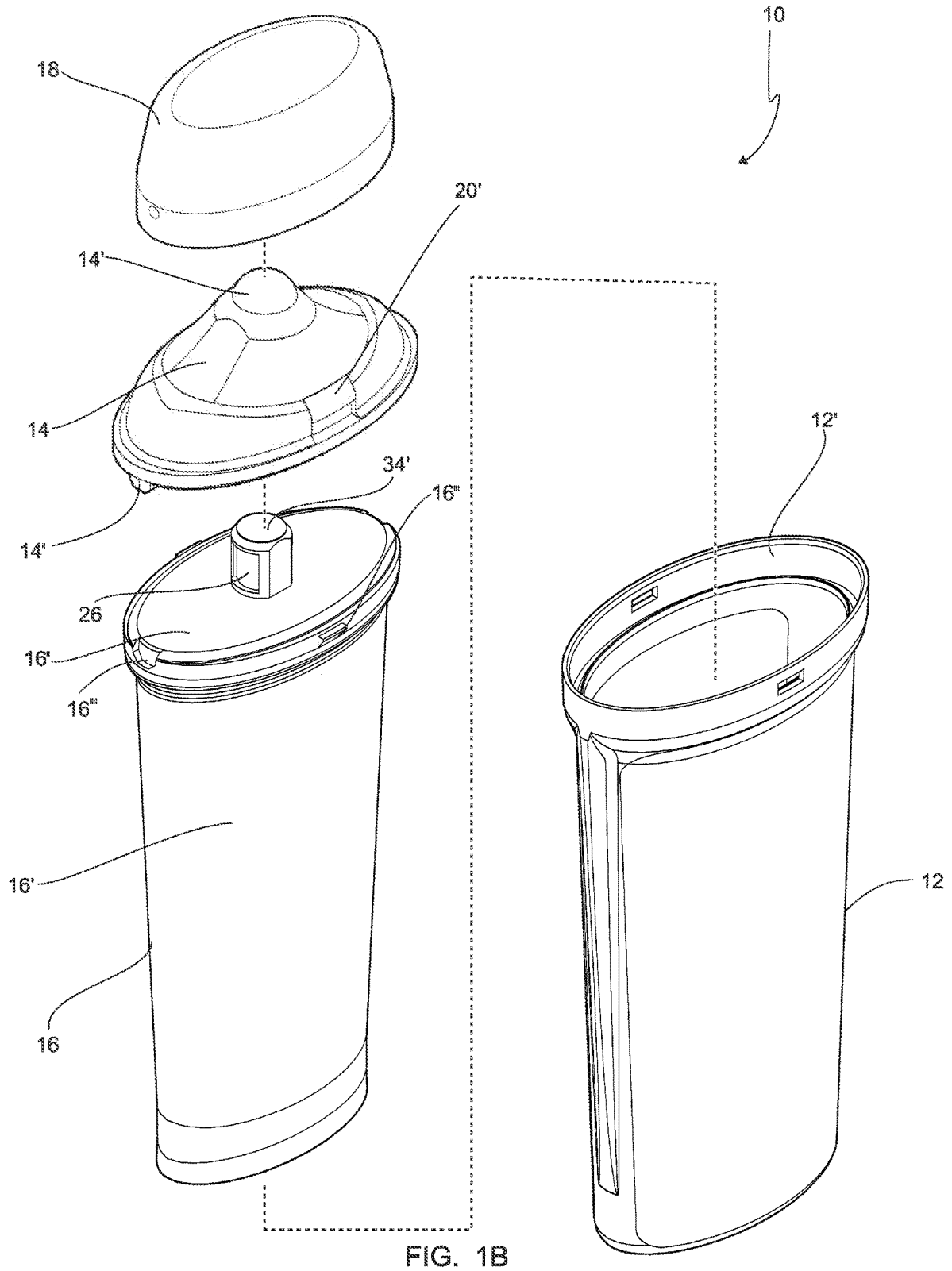
FIG. 1B is a perspective view of the dispenser of FIG. 1 in a first partially disassembled configuration.

FIG. 1B illustrates a perspective view of a disassembled dispenser 10 like the one shown in FIG. 1A.

The dispenser 10 comprises a content container 16 for storing the liquid to be dispensed, and which can be exchanged once the content container 16 is empty. The content container 16 comprises a content housing part 16' which may be formed from a polymer, and a content housing lid part 16" integrated with the content housing part 16', to create a closed chamber for the liquid. The upper end of the content container 16 comprises a nozzle with an opening 34 (see, e.g., FIG. 1C), which in FIG. 1B is closed with a sealing 34', such as an aluminum foil, plastic covering, or a similar sealing material, to preserve the liquid before the content container 16 is inserted into the dispenser 10.

When inserting the content container 16 into the dispenser 10 through the container body opening 12', and the dispenser head 14 is connected, piercing means 42 (see FIG. 4) pierces the sealing 34', whereby the liquid can be dispensed out of the content container 16.

The content container 16 comprises opposite content container locking means 16'", shown as protrusions, for interlocking with opposite corresponding openings in the container body 12 at the content body opening 12', such as in a snap fit connection. When squeezing the container body 12 on opposite sides between the opposed openings, the content container locking means 16'" disengages the openings and the content container may be removed from the content housing 12. The content container locking means 16'" may be or may include a protrusion, a projection, a protuberance, an overhang, a ledge, a shelf, or a ridge. The content container locking means 16'" may define a wedge or triangular shape configured to be received in a corresponding orifice or hole of the container body 12.

The dispenser head 14, which is shown as being oval comprises a dispenser nozzle 14' for dispensing the liquid out of the dispenser and the dispenser head 14 being arranged from a harder material, such as hard plastic, compared to the wall(s) of the container body. The dispenser head 14 comprises projecting elements 14" at opposite sides. Only one projecting element 14" is shown at one of the sides with the low curvature, but it should be understood that another projecting element 14" is also arranged at the opposite side.

The projecting elements 14" engage corresponding cutouts 16"", such that when the dispenser head 14 is connected to the container body 12, the projecting elements 14" prevents the container body 12 from being deformed by a squeezing at the low curvature sides. This prevents the content container locking means 16'" from disengaging the corresponding openings in the container body 12 and hereby preventing the content container 16 from being removed from the container body 12 by an accident or unintentionally.

The dispenser head 14 further comprises internally arranged pressure-sensitive locking means 20 (see FIGS. 2, 3A and 3B) for interlocking with cooperating locking means 26 on the content container 16.

The pressure-sensitive locking means 20 comprises pressure-sensitive parts 20' on each side of the dispenser head 14 (the sides of high curvature) for being manipulated by a user and locking parts 20" which interlock with the cooperating locking means 26 by snap fit and disengage the cooperating locking means 26 when the pressure-sensitive parts 20' are being pressed inwards/manipulated. The cooperating locking means 26 may include a projection configured to act as a nozzle and extending above the content housing lid part 16". The projection configured to act as a nozzle may include opposing indents, recesses, or orifices configured to receive the locking parts 20" therein. The shapes of the locking parts 20" may correspond with the shapes of the opposing indents, recesses, or orifices. The pressure-sensitive locking means 20 may be a locking assembly including depressible arms (e.g., pressure-sensitive parts 20') configured to be squeezed by a user's hands and/or configured to be depressed when receive in corresponding orifices defined in the dispenser head 14'. The locking assembly may also include biasing elements 24 that are integrally connected with the pressure-sensitive parts 20'. The biasing elements 24 may operate similarly to compression springs. The biasing elements 24 may be formed of a bendable polymer that has a material memory that restores the biasing elements 24 to their original shape and position (see, e.g., FIGS. 3A and 3B).

Figure 1C:
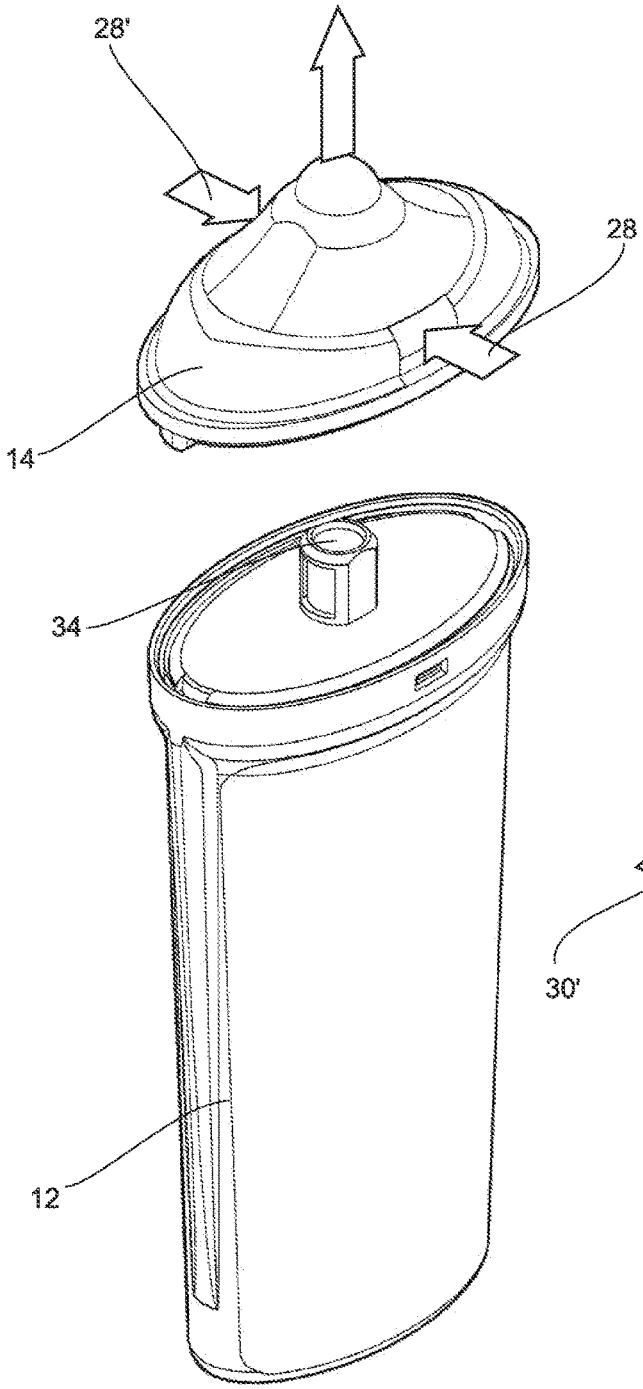
FIG. 1C is a perspective view of the dispenser of FIG. 1 in a second partially disassembled configuration.
Figure 1D:
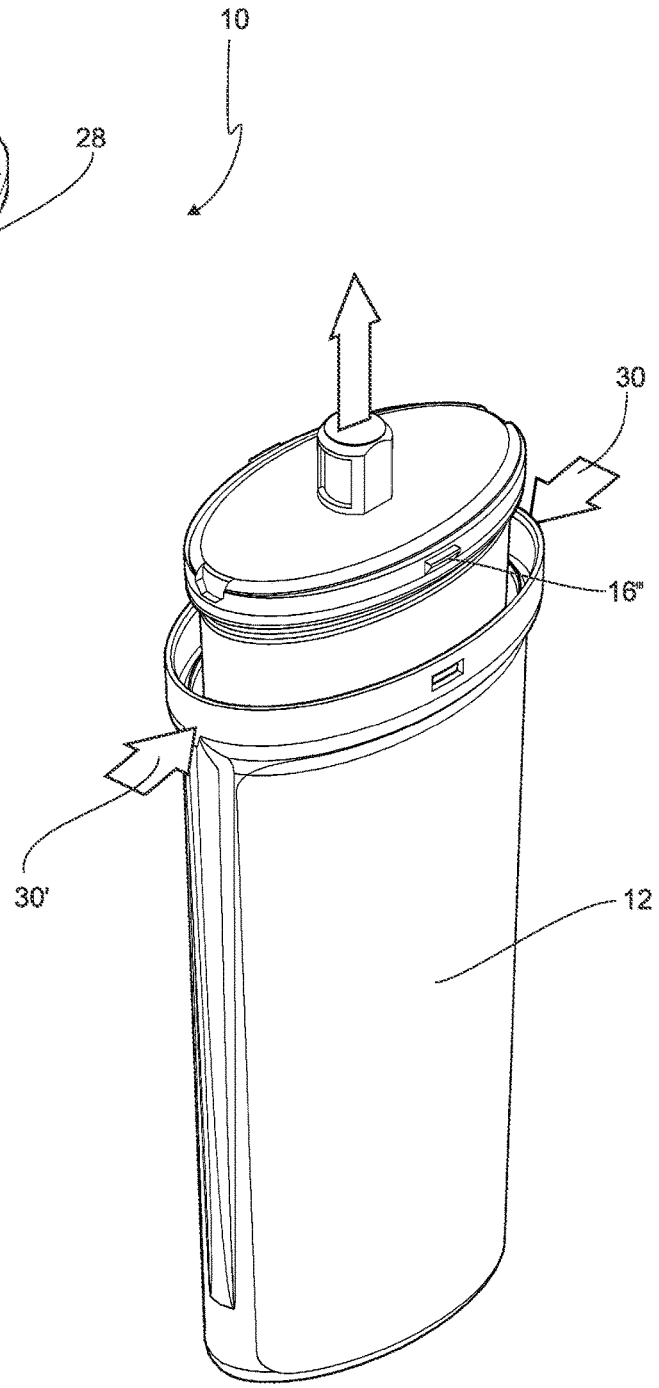
FIG. 1D is a perspective view of the dispenser of FIG. 1 in a third partially disassembled configuration.

FIGS. 1C-1D show perspective views of a partially disassembled dispenser 10.

The figures show exemplary steps for removing the content container 16 out of the container body 12.

Referring to FIG. 1C, and in use, the dispenser head 14 may first be removed from the container body 12 by pressing the opposed pressure-sensitive parts 20' toward each other in first and second directions 28, 28'. Thereby, the locking parts 20" disengage the cooperating locking means 26 and the dispenser head 14 can be removed (e.g., by lifting the dispenser head 14 in an upward direction away from the container body 12.

Referring to FIG. 1D, and as previously described, once the dispenser head 14 is removed and the projecting elements 14" are removed out of the cutouts 16", the low curvature sides of the container body 12 may be pressed, by a user, in opposite third and fourth directions 30, 30' whereby the content container locking means 16'" disengages the openings at the upper end of the container body 12 and the content container 16 can be removed from the container body 12 and replaced.

Figure 2:
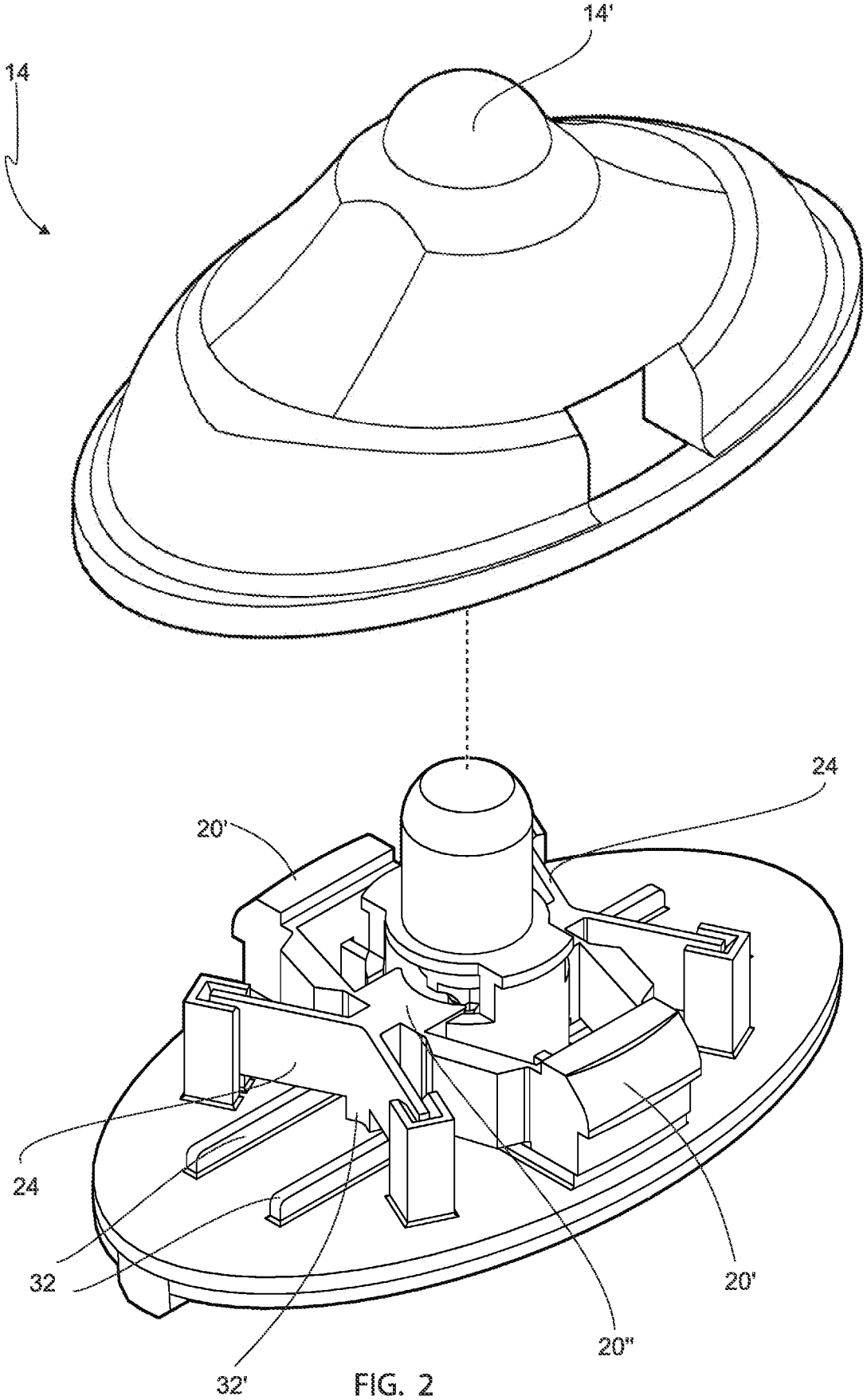
FIG. 2 is a perspective view of a partially disassembled dispenser head of the dispenser of FIG. 1.

FIG. 2 shows a perspective view of a disassembled dispenser head 14.

The dispenser head 14 is shown having two parts, an upper part including the top part of the dispenser head 14 with the dispenser nozzle 14' and a lower part having the projecting elements 14", the upper and lower part defining a chamber wherein the pressure-sensitive locking means 20 are arranged. The upper part comprises openings of the high curvature sides such that the pressure sensitive parts 20' may protrude out of the openings for manipulation by a user.

The pressure-sensitive locking means 20 further comprises the shown locking parts 20" for interlocking with the cooperating locking means 26 on the content container 16.

In order to ensure a safe and reliable locking between the dispenser head 14 and the content container 16, the locking parts 20" are biased into a locked position by biasing elements 24. It is thereby ensured that a minimum required force is necessary for removing the dispenser head 14, and whereby a relatively more reliable locking is established.

The lower part of the dispenser head 14 further comprises guide means 32 for guiding a guiding tap 32' on the locking parts 20". This feature ensures that when pressing the pressure-sensitive parts 20', the locking parts 20" are correctly guided in the third and fourth direction for secure locking operation. The guide means 32 may include opposing raised walls, guide bars, or continuous projections configured to receive the guide tap 32' therebetween. The guide tap 32' may be a downward extending projection extending below biasing member 24 and received between upward extending walls, guide bars, or continuous projections of the guide means 32.

Figure 3A:
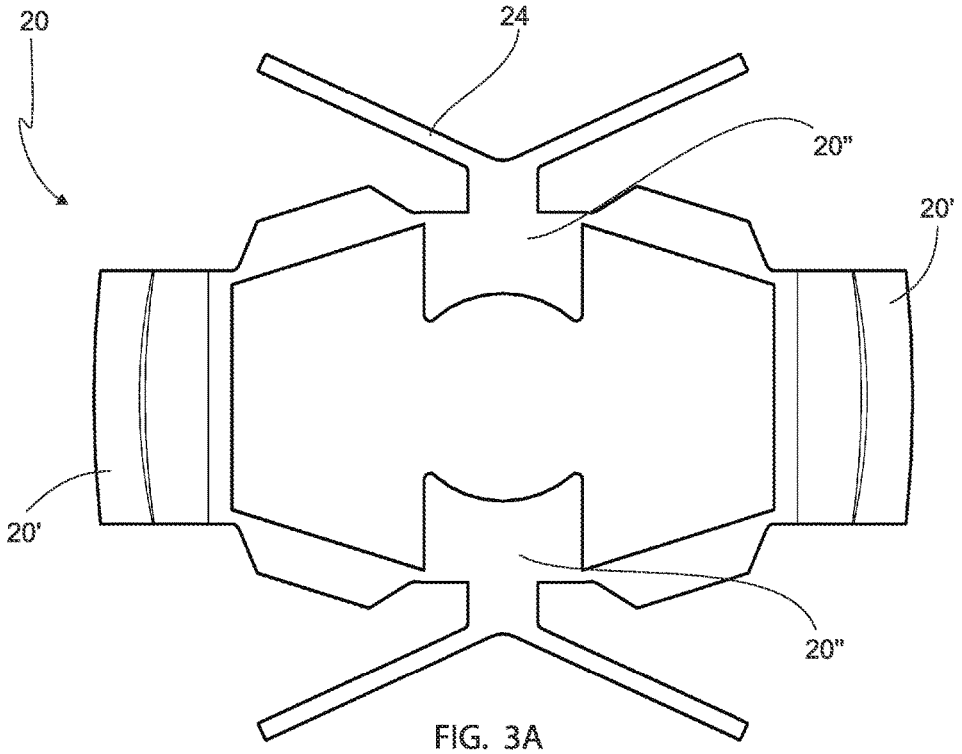
FIG. 3A is a first top plan view of the pressure-sensitive locking means of the dispenser of FIG. 1.
Figure 3B:
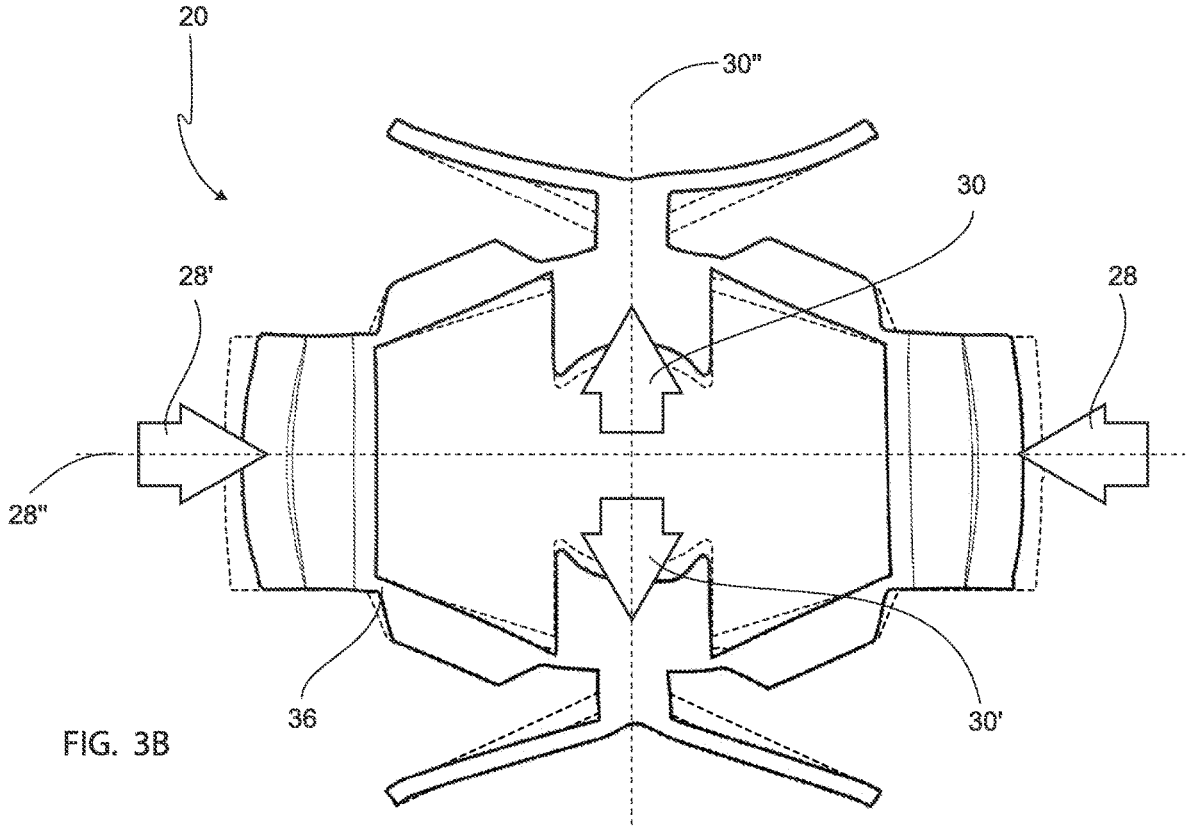
FIG. 3B is a second top plan view of the pressure-sensitive locking means of the dispenser of FIG. 1.

FIGS. 3A-3B show top plan views of the pressure-sensitive locking means 20 of FIG. 2.

The locking means 20 are preferably arranged as a unitary piece of e.g., plastic, such that (as shown in FIG. 2) the locking means 20 encircles the nozzle and opening 34 of the content container 16, whereby a more reliable locking is effectuated.

The locking means 20 may include deformable regions 36 arranged between the pressure-sensitive parts 20' and the locking parts 20" such that the locking means 20 may deform in order for the locking parts 20" to be able to engage and disengage from the cooperating locking means 26 on the content container 16.

Referring to FIG. 3B, the pressure-sensitive parts 20' are pressed in the first and second direction 28, 28' aligned in a first path 28". The locking means 20 deforms via the deformable regions 36 whereby the locking parts 20" move in the third and fourth direction 30, 30' aligned in a second linear path 30", the second linear part 30" preferably being substantially perpendicular to the first linear part 28". Thereby, an effective and fail-safe locking process is ensured.

Referring particularly to FIG. 3B, as the locking means 20 is deformed the locking parts 20" move against the biasing force from the biasing elements 24. The force from the biasing elements 24 is arranged such that the locking means 20 can be operated by a user, while at the same time the locking parts 20" are kept in engagement with the cooperating locking means 26 on the content container 16 when the pressure-sensitive parts 20' are not manipulated.

Figure 4A:
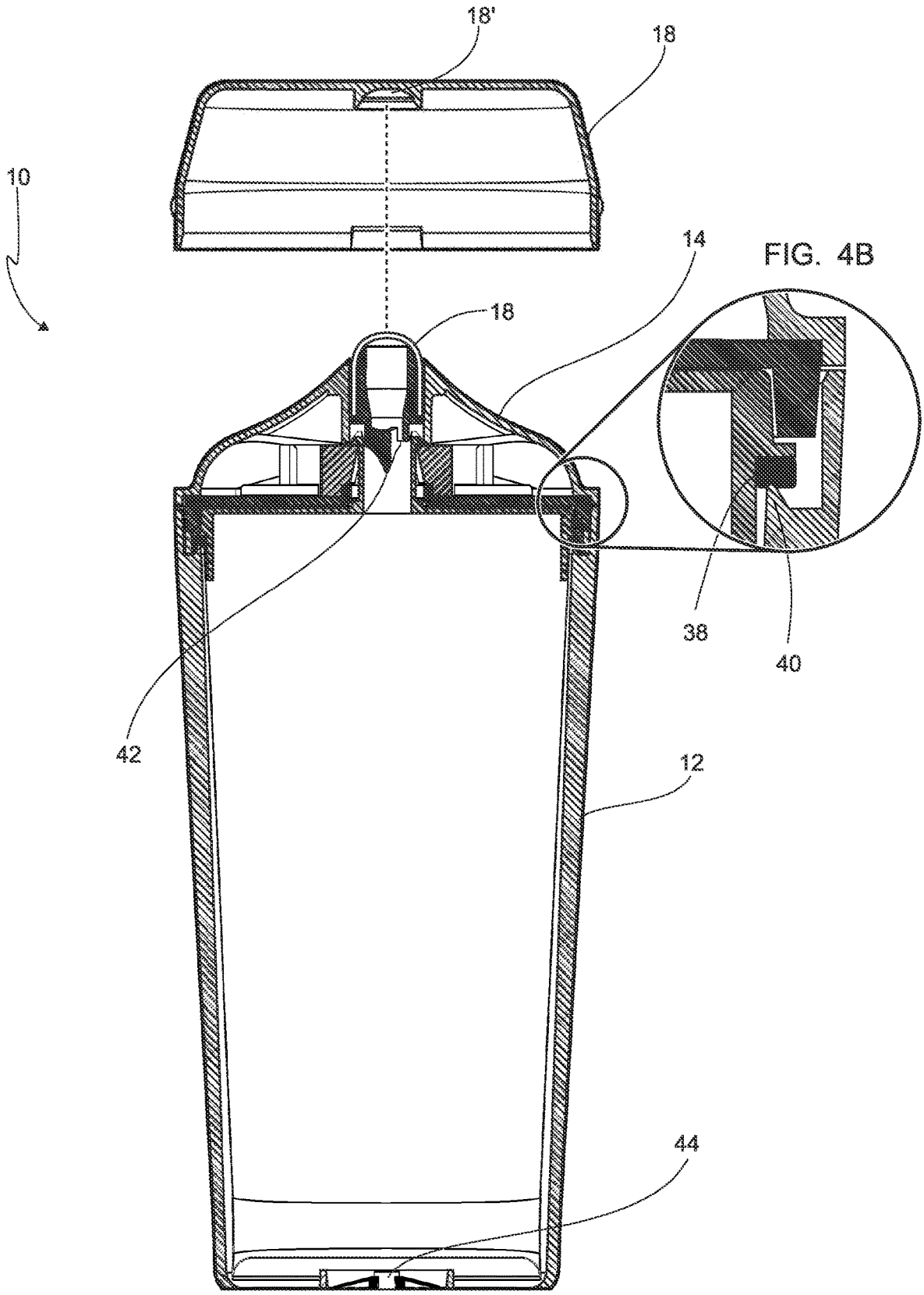
FIG. 4A is a cross-sectional view of the dispenser of FIG. 1.

FIG. 4A shows a cross-sectional view of the dispenser 10.

Referring to FIG. 4A, the dispenser head 14 comprises piercing means 42 which penetrates the sealing 34' (see FIG. 1B) once the dispenser head 14 is connected. The piercing means 42 may include a sharp point or sharp projection extending from the dispenser head 14 and configured to pierce sealing 34'.

The content container 16, at the content housing lid part 16", comprises a first sealing part 38 arranged as a flange which engages a second sealing part 40 arranged as a flexible sealing, such as a rubber sealing, connected to the interior of the container body 12 at the container body opening 12'.

The container lid 18 is arranged on the inner top side thereof with a nozzle engagement portion 18'. The nozzle engagement position presses against the dispenser nozzle 14' when the dispenser lid 18 is attached, whereby it is ensured that a small remaining amount of liquid still present in the dispenser nozzle 14' will not flow out of the dispenser nozzle 14' and into the dispenser lid 18.

The nozzle engagement portion 18' has a shape such that it conforms to the shape of the dispenser nozzle 14'. It is hereby ensured that space between the dispenser nozzle 14' and the dispenser lid is kept at a minimum, such that even if a small amount of liquid would escape the dispenser nozzle 14, it would be an insignificantly low amount of liquid.

The container body 12 may further comprise a valve 44, such as a one-way valve. The valve 44 serves to equalize the pressure inside the container body 12 around the content container 16, such that the pressure corresponds to the ambient pressure after a force has been applied to the dispenser 10 and released again. It is hereby possible to arrange a collapsible content container 16, where it is ensured that a maximum amount of liquid is dispensed out of the content container 16, such that when removing the content container 16 from the dispenser 10 a very small amount of liquid is remaining inside the content container 16.

FIG. 4B shows an enlarged view of a portion of the dispenser 10.

Referring to FIG. 4B, a seal may be formed between the content container 16 and the container body 12. For example, the content container 16 is arranged with a first sealing part 38, such as a packing made of rubber or the like and the container body 12 is arranged with a second sealing part arranged as a rim. Other types of sealing may be used.

The container body 12 and the content container 16, which by engagement of the first and second sealing parts 38 and 40 forms a tight seal, such that a pressure tight chamber is formed around the content container 16.

The container body 12 may comprise a one-way valve 44 at the bottom thereof, which is blocked during applied pressure be a user, thereby preventing air from leaving the chamber, but allows air to flow into the chamber when the user releases the pressure, and the container body 12 returns to the initial mode and shape.

It will be understood that various modifications may be made to the aspects and features disclosed herein. Therefore, the above description should not be construed as limiting, but merely as exemplifications of various aspects and features. Those skilled in the art will envision other modifications within the scope and spirit of the claims appended thereto.

What is claimed is:

1. A dispenser assembly, comprising:

a content container configured to hold liquid therein, the content container including cooperating locking means;

a container body including a bottom and a sidewall extending from the bottom, the container body defining a container body opening opposite to the bottom, wherein the container body is configured to receive the content container therein; and a dispenser head removably coupled with the content container, the dispenser head including:

a dispenser nozzle configured to dispense liquid from the content container; and pressure-sensitive locking means configured to be releasably coupled with the cooperating locking means of the content container so as to releasably couple the dispenser head with the content container, wherein the pressure-sensitive locking means comprises (a) opposed pressure-sensitive parts movable by an applied pressure toward each other respectively in first and second opposed directions aligned along a first linear path; and (b) opposed locking parts movable by the pressure-sensitive parts away from each other respectively in third and fourth opposed directions aligned along a second linear path, wherein the first linear path is substantially perpendicular to the second linear path, and wherein the opposed locking parts are arranged so as to engage with the cooperating locking means of the content container.

2. The dispenser assembly of claim 1, wherein the opposed pressure-sensitive parts and the opposed locking parts define a unitary structure.

3. The dispenser assembly of claim 1, wherein the opposed pressure-sensitive parts include a biasing element configured to bias the opposed locking parts toward each other.

4. The dispenser assembly of claim 1, wherein the opposed locking parts include a biasing element configured to bias the opposed locking parts toward each other.

5. The dispenser assembly of claim 1, wherein the dispenser head includes a guide configured to guide the opposed locking parts away from each other in the third and fourth directions.

6. The dispenser assembly of claim 1, wherein the content container defines a content container opening configured to dispense liquid from the content container to the dispenser head, and wherein the pressure-sensitive locking means encircles the content container opening and is releasably coupled with the cooperating locking means of the content container adjacent the content container opening.

7. The dispenser assembly of claim 1, wherein the pressure-sensitive locking means defines deformable regions between the opposed pressure-sensitive parts and the opposed locking parts, wherein the deformable regions are configured to allow the opposed pressure-sensitive parts and the opposed locking parts to be displaced with respect to each other.

8. The dispenser assembly of claim 1, wherein the content container includes a housing configured to hold liquid contained in the content container, and a housing lid configured to seal the content container.

9. The dispenser assembly of claim 8, wherein the housing is collapsible.

10. The dispenser assembly of claim 1, wherein the dispenser head includes at least two projecting elements configured to be received in the container body opening, wherein the at least two projecting elements are configured to prevent deformation of the container body in the region of the at least two projecting elements.

11. The dispenser assembly according to claim 10, wherein the content container defines at least two cutouts configured to engage the at least two projecting elements.

12. The dispenser assembly according to claim 1, further comprising content container locking means configured to engage the dispensing head with the content container body.

13. The dispenser assembly according to claim 1, further comprising a dispenser lid covering the dispenser head.

14. The dispenser assembly according to claim 13, wherein the dispenser lid is removably coupled with the pressure-sensitive locking means.

15. The dispenser assembly according to claim 13, wherein the dispenser lid includes a nozzle engagement portion coupled with the dispenser nozzle so as to prevent liquid from being dispensed from the content container through the dispenser nozzle.

16. The dispenser assembly according to claim 15, wherein the nozzle engagement portion and the dispenser nozzle have corresponding shapes.

17. The dispenser assembly according to claim 8, wherein the housing lid includes a first sealing part, wherein the container body includes a second sealing part, and wherein the first sealing part is engageable with the second sealing part so as to establish a pressure-tight seal between the housing lid and the content container body.

18. A dispenser assembly, comprising:

a content container configured to hold liquid therein, the content container including cooperating locking means, a content container opening, and a seal covering the content container opening;

a container body including a bottom and a sidewall extending from the bottom, the container body defining a container body opening opposite to the bottom, wherein the container body is configured to receive the content container therein; and a dispenser head removably coupled with the content container, the dispenser head including (a) a dispenser nozzle configured to dispense liquid from the content container through the content container opening; (b) a piercing element configured to pierce the seal of the content container; and (c) pressure-sensitive locking means releasably coupled with the cooperating locking means of the content container so as to releasably couple the dispenser head with the content container.

19. The dispenser assembly according to claim 1, wherein at least one of the container body and the dispenser head includes a one-way valve.

20. A dispenser assembly, comprising:

a flexible content container including (a) a housing configured to hold liquid therein; (b) a housing lid configured to seal the housing; (c) a content container locking means defining a first projection extending in a first direction and a second projection extending in a second direction opposite the first direction; (d) a first projecting element extending in a third direction; (e) a second projecting element extending in a fourth direction opposite the third direction; wherein the third and fourth directions are substantially perpendicular to the first and second directions; and (f) cooperating locking means;

a container body configured to receive the flexible content container therein, wherein the content container locking means is configured to removably couple the flexible content container with the container body, and wherein the first projecting element and the second projecting element are configured to prevent deformation of the container body; and a dispenser head removably coupled with the flexible content container, the dispenser head including (a) a dispenser nozzle configured to dispense liquid from the flexible content container; and (b) pressure-sensitive locking means releasably coupling the cooperating locking means of the flexible content container so as to releasably couple the dispenser head with the flexible content container.

* * * * *